US009417649B2

(12) United States Patent
Herrity

(10) Patent No.: US 9,417,649 B2
(45) Date of Patent: Aug. 16, 2016

(54) METHOD AND APPARATUS FOR A FLOATING CURRENT SOURCE

(71) Applicant: Omron Network Products, LLC, Pleasanton, CA (US)

(72) Inventor: Kenneth Herrity, Milpitas, CA (US)

(73) Assignee: Omron Management Center of America, Inc., Hoffman Estates, IL (US)

( * ) Notice: Subject to any disclaimer, the term of this patent is extended or adjusted under 35 U.S.C. 154(b) by 294 days.

(21) Appl. No.: 14/046,250

(22) Filed: Oct. 4, 2013

(65) Prior Publication Data

US 2015/0097547 A1 Apr. 9, 2015

(51) Int. Cl.
*G05F 3/08* (2006.01)

(52) U.S. Cl.
CPC ..... *G05F 3/08* (2013.01)

(58) Field of Classification Search
CPC ..... G05F 3/08
USPC ..... 323/312
See application file for complete search history.

(56) References Cited

U.S. PATENT DOCUMENTS 4,322,586 A * 3/1982 Mein ..... H04M 19/005 379/377
4,528,495 A 7/1985 Dorsman
5,309,295 A 5/1994 Bailey et al.
6,229,351 B1 * 5/2001 Wang ..... G01R 19/00 327/103
2012/0206150 A1 * 8/2012 Holzer ..... H03G 1/0088 324/537
2015/0048678 A1 * 2/2015 Gong ..... H05B 33/0851 307/24

FOREIGN PATENT DOCUMENTS

CA 1139470 A1 1/1983
JP 2000-036564 A * 2/2000
WO 9964875 12/1999

* cited by examiner

*Primary Examiner* — Timothy J Dole
*Assistant Examiner* — Htet Z Kyaw
(74) *Attorney, Agent, or Firm* — Murphy, Bilak & Homiller, PLLC

(57) ABSTRACT

As taught herein, a floating current source outputs a load biasing current from a source terminal into an external load which may have a variable resistance, and sinks the load biasing current from the load into a sink terminal. Advantageously, the floating current source includes a single-transistor current sink having a bias control that sets the magnitude of the load biasing current desired, and further includes a single-transistor current source that self-biases from the float voltage developed on the external load to an operating point at which the single-transistor current source sources the desired magnitude of load biasing current. One or more AC shunts within the self-biasing network prevent any AC fluctuations present or impressed on the source terminal of the floating current source from changing the operating point of the single-transistor current source, thereby imparting a high effective impedance to the single-transistor current source.

13 Claims, 9 Drawing Sheets

METHOD AND APPARATUS FOR A FLOATING CURRENT SOURCE

TECHNICAL FIELD

The present invention generally relates to electrical circuits configured as current sources, and particularly relates to two-transistor floating current source, e.g., for providing a biasing current to a resistor or other load at a desired float voltage.

BACKGROUND

Current sources are used in a variety of applications. An ideal current source has infinite source impedance and is insensitive to the voltage present at its source terminal. An ideal current sink behaves similarly, i.e., the magnitude of current drawn by the sink terminal is insensitive to the voltage present on the sink terminal.

Although practical current sources deviate from ideal behavior, current sources find wide use in a range of circuit applications and practical current sources having good real-world behavior can be constructed. While current sources may be implemented using relatively simple circuitry, more complex circuitry is typically used for more sophisticated application, such as in the implementation of so called floating current sources.

For example, certain types of sensors operate as variable resistors and require a bias voltage across their resistor terminals in order to operate properly. Similarly, some controllable resistors also require a bias voltage across the controllable resistor pins. Because a true floating current source presents high impedance to both pins of the resistor being biased, it is possible to use it to bias variable or controllable resistors in applications where both pins of the resistor must appear to float with respect to the bias network.

In some applications, it is also useful to float the resistor at some known DC voltage with respect to circuitry used to vary the resistance of a controllable resistor or circuitry used to detect the resistance of a variable resistor, while still presenting high AC impedance to both pins of the resistor being biased. Some known circuits are referred to as floating current sources although they do not truly "float," because one terminal exhibits low impedance with respect to some voltage source, e.g., ground or power. In other instances, circuits referred to as floating current sources in reality operate as floating current sinks and require some minimum external voltage across the current sink terminals.

Further, while true floating current sources are known, such circuits generally use multiple operational amplifiers and/or combinations of several transistors and supporting circuitry, which circuitry is comparatively complex as compared to the teachings presented herein. Such complexity leads to undesirable cost and, in some cases, excessive component count and/or consumption of limited circuit board area.

SUMMARY

As taught herein, a floating current source outputs a load biasing current from a source terminal into an external load which may have a variable resistance, and sinks the load biasing current from the load into a sink terminal. Advantageously, the floating current source includes a single-transistor current sink having a bias control that sets the magnitude of the load biasing current desired, and further includes a single-transistor current source that self-biases to produce the same magnitude of current as the single transistor current sink with the source pin biased to a known high impedance DC float Voltage. After a short period of stabilization, both the source and sink terminals of the floating current source will provide a constant current through a variable resistance load. One or more AC shunts within the self-biasing network prevent any AC fluctuations present or impressed on the source terminal of the floating current source from changing the operating point of the single-transistor current source, thereby imparting a high effective impedance to the single-transistor current source.

The above arrangement enables a simple, high-impedance, two-transistor circuit to provide a fixed bias current to a variable resistance load, while floating the load at a known DC voltage.

Of course, the present invention is not limited to the above features and advantages. Indeed, those skilled in the art will recognize additional features and advantages upon reading the following detailed description, and upon viewing the accompanying drawings.

DETAILED DESCRIPTION

Figure 1:
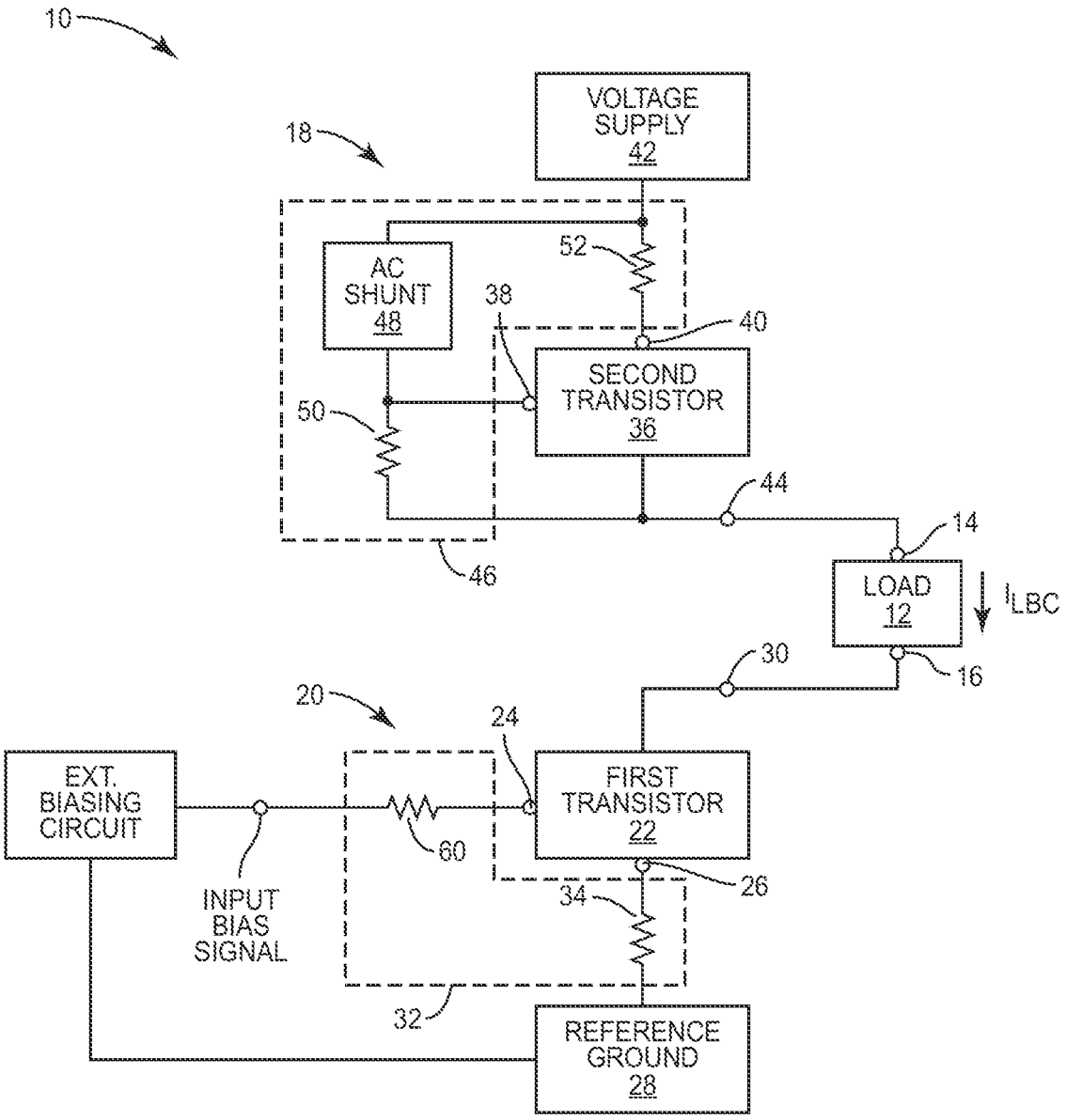
FIG. 1 depicts a block diagram of a floating current source according to an embodiment.

FIG. 1 illustrates one embodiment of a floating current source 10 that provides a load biasing current $I_{LBC}$. The load biasing current $I_{LBC}$ is provided across an external load 12 having first and second terminals 14, 16. The floating current source 10 includes a single-transistor current source 18 that supplies the load biasing current $I_{LBC}$ across the external load 12. The floating current source 10 additionally includes a single-transistor current sink 20 that sinks the load biasing current $I_{LBC}$. The magnitude of the load biasing current $I_{LBC}$ to be sunk by the single-transistor current sink 20 is set by a biasing network of the single-transistor current sink 20, in dependence on the biasing signal input to that biasing network.

In more detail, the single-transistor current sink 20 includes a first transistor 22. The first transistor 22 has a first terminal 24, a second terminal 26 and a third terminal 30. The second terminal 26 is coupled to a reference ground 28. The third terminal 30 is coupled to the second terminal 16 of the load 12 and operative as a sink terminal of the floating current source 10. The first terminal 24 is coupled to a first biasing network 32, which, in combination with its input bias signal, controls the magnitude of the load biasing current, $I_{LBC}$.

The single-transistor current source 18 includes a second transistor 36. The second transistor 36 has a first terminal 38, a second terminal 40 and a third terminal 44. The second terminal 40 is coupled to a voltage supply 42. The third terminal 44 is coupled to the first terminal 14 of the external load 12 and operative as a source terminal of the floating current source 10. The first terminal 38 is coupled to a second biasing network 46. As further detailed below, the second biasing network 46 is configured such that the single-transistor current source 18 self-biases as taught herein.

In particular, second biasing network 46 automatically biases the second transistor 36 to source current $I_{LBC}$, as set according to the bias of the first transistor 22 in the single-transistor current sink 20, and to fix the DC voltage drop from the voltage supply 42 to the source terminal 44 to a constant value proportional to $I_{LBC}$. According to this contemplated arrangement, the DC voltage between the supply voltage 42 and the source terminal 44 of the floating current source 10 can be expressed as $$V=I/K+C$$

where I is the positive current source from the source terminal 44, V is the voltage across the single-transistor current source 18—i.e., the voltage drop between the voltage supply 42 and the source terminal 44, K is the transconductance of the single-transistor current source 18, and C is a constant offset that is determined by the implementation of the single-current source 18.

From a DC perspective, the single-transistor current source 18 will appear like a resistor with a resistance inversely proportional to K. However, the single-transistor current source 18 presents high-impedance to any AC voltage developed on the source terminal 44 because of the AC shunting included in the biasing network 46. Consider FIG. 2, which illustrates an example embodiment of the single-transistor current source 18, where a capacitor is used as the AC shunt 48, and where the second transistor 36 is implemented as a PNP Bipolar Junction Transistor (BJT).

The DC collector-emitter current, $I_{ce}$, through the transistor 36. This current may be calculated as $$I_{ce} = \left(\frac{V_{ce} - V_{be}}{R}\right) \cdot h_{fe},$$

where $V_{ce}$ is the collector-emitter voltage across the transistor 36, $V_{be}$ is the base-emitter voltage across the transistor 36, R is the resistance of resistor 50, and $h_{fe}$ is the DC Current Gain of the transistor 36. The capacitor C used to implement the AC shunt 48 is operative to shunt any AC current to the positive supply, denoted as $V_{SUPPLY}$ in the drawing. As a result, the base-emitter current $I_{be}$ through transistor 36 remains constant in the presence of an AC voltage on the source terminal 44.

Now, because $I_{ce}=I_{be} \cdot h_{fe}$, the use of AC shunting to make the current $I_{be}$ insensitive to AC fluctuations on the source terminal 44 also means that the current $I_{ce}$ remains constant in the presence of such fluctuations (within overall practical operating limits). Moreover, one sees that the transistor 36 in the single-transistor current source 18 will be biased as a function of $I_{LBC}$. Since the current I being sourced from terminal 44 must be $I_{LBC}$ as set by the first transistor 22, $V_{FLOAT}$ must be a function of $I_{LBC}$.

Viewed another way, with the depicted biasing arrangement, the transistor 36 will self-set to an operating point at which $$V = \frac{I}{K} + C,$$

and $V_{FLOAT}$ therefore can be expressed as $$V_{FLOAT} = V_{SUPPLY} - \left(\frac{I}{K} + C\right).$$

In other words, the biasing network 46 in the single-transistor current source 18 biases the second transistor 36 so that the current sourced from source terminal 44 is equal to $I_{LBC}$ as set by the single-transistor current sink 20. The self-biasing operation of the single-transistor current source 18 occurs as a result of coupling the first terminal 38 to the third terminal 44 of the second transistor 36.

Figure 2:
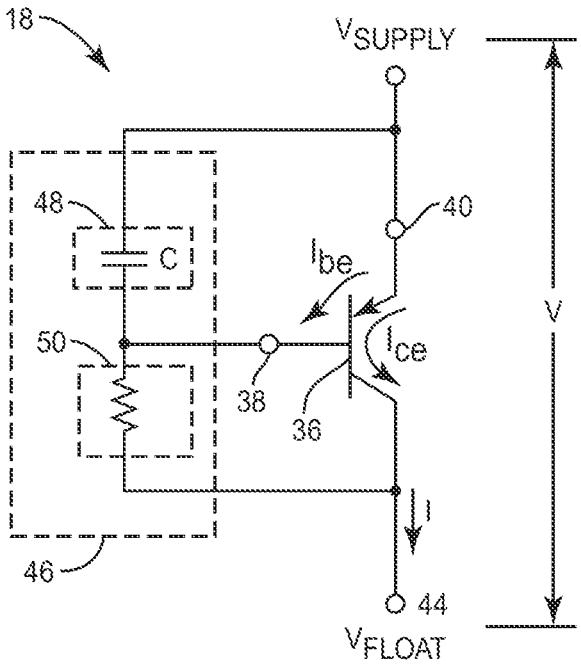
FIG. 2 depicts a circuit configuration of a single-transistor current source according to an embodiment.

As shown in the examples of FIGS. 1 and 2, a resistor 50 of the second biasing network 45 is coupled between the first terminal 38 and the third terminal 44. This coupling pairs the base-emitter current $I_{be}$ with the float voltage, $V_{FLOAT}$, on the source terminal 44. Because $I_{LBC}$ is set by the single-transistor current sink 20 and because the collector-emitter current $I_{ce}$ of the second transistor 36 must be equal to $I_{LBC}$, the base-emitter $I_{be}$ current must be $$I_{be} = \frac{I_{LBC}}{h_{fe}}.$$

From this, one sees that the float voltage on the source terminal 44 will be automatically set by the current through the resistor 50 (which must be equal to $I_{be}$) and the voltage across the resistor 50 (which is proportional to the resistor value).

Advantageously, however, the self-biasing operation is "isolated" from AC fluctuations that are impressed on the third terminal 44 of the second transistor 36 (i.e., the source terminal 44) or that otherwise appear on that terminal. To achieve such isolation, the second biasing network 46 that self-biases the transistor 36 of the single-transistor current source 18 includes one or more AC shunt(s) 48 that prevent AC components appearing at the source terminal 44 from affecting the (DC) biasing signal used for self-biasing the single-transistor current source 18. Here, the word "prevent" should be understood within the context of practical circuit limitations—e.g., "prevent" means to substantially suppress, at least within a given frequency range.

The component quality used in the one or more AC shunt (s), and the electrical layout (e.g., wire/PCB trace arrangements, etc.) can be optimized for desired frequency ranges and desired levels of shunting performance. In one example, the AC fluctuations arise from communication signals impressed across the load by an external communication transmitter, and the AC shunt(s) 48 shunt the corresponding AC signals into the voltage supply 42 from which the load biasing current $I_{LBC}$ is sourced.

Figure 3A:
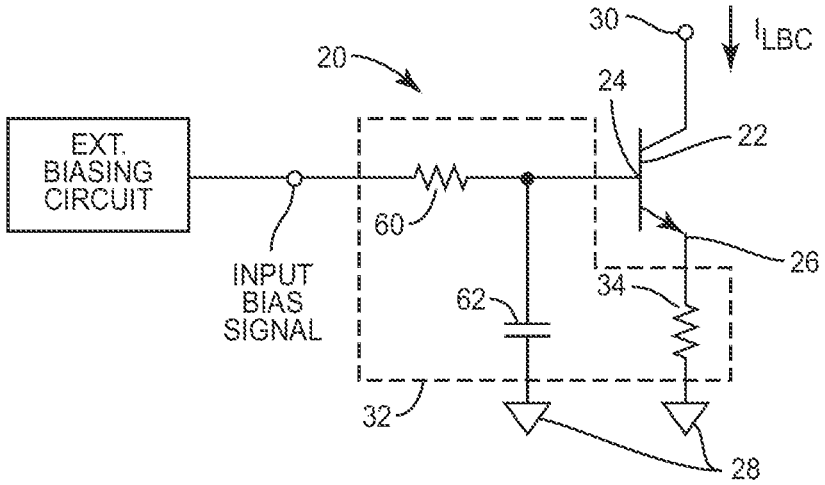
FIGS. 3A-3C depict circuit configurations of a single-transistor current sink component of a floating current source according to embodiments.
Figure 3B:
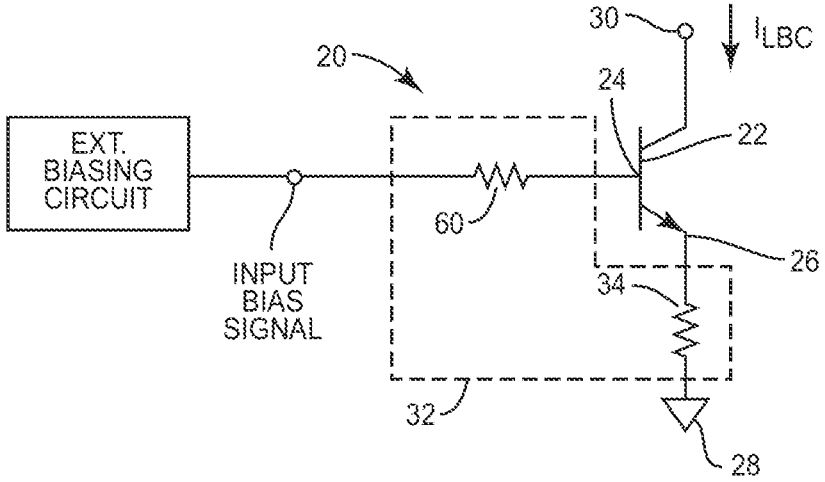
Figure 3C:
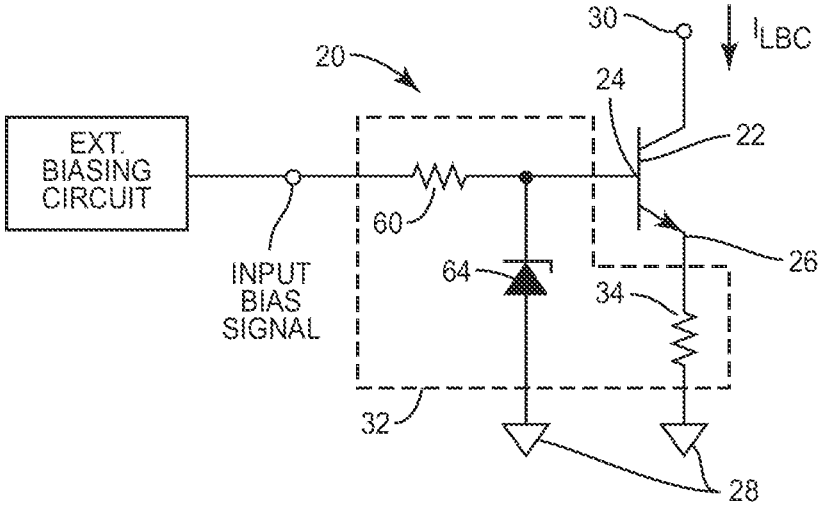

Different types of transistors may be used in the contemplated floating current source 10, and different biasing network arrangements may be used. FIGS. 3A-3C illustrate the single-transistor current sink 20 in which the transistor 22 is implemented as a NPN Bipolar Junction Transistor (BJT), where each figure illustrates a non-limiting example configuration for the biasing network 32.

In FIG. 3A, the biasing network 32 includes a resistor 60 in series between the biasing input and the base terminal 24 of the transistor 22. A shunt capacitor 62 from the base terminal 24 adds a filtering component, and (resistive) element 34 provides emitter generation feedback, which improves stability and linearity of the transistor 22 at the desired operating point.

FIG. 3B omits the shunt capacitor 62 and FIG. 3C uses a Zener diode 64 on the base terminal 24 to fix the bias of the transistor 22. In this regard, it will be understood that circuit elements referenced with the same reference numeral do not necessarily have the same value. For example, while resistor 60 is a series input resistor in FIGS. 3A, 3B and 3C, it may have a different value in the various configurations to suit the overall biasing arrangement being used.

Figure 4A:
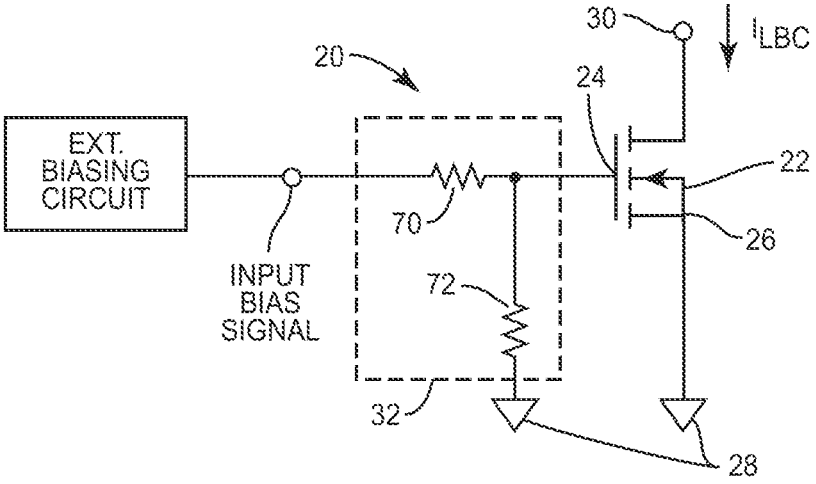
FIGS. 4A-4B depict additional circuit configurations of a single-transistor current sink component of a floating current source according to embodiments.
Figure 4B:
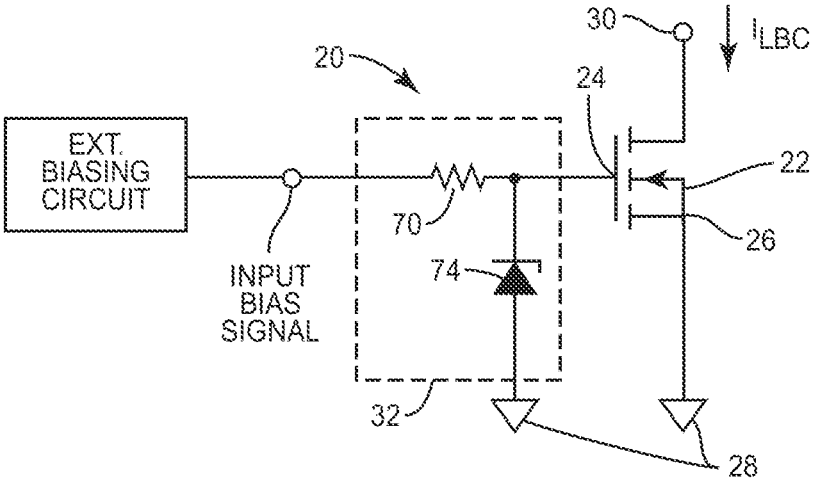

FIGS. 4A-4B are similar, but depict the use of an n-type Metal Oxide Semiconductor Field Effect Transistor (MOSFET) configuration for the transistor 22. FIG. 4A illustrates a voltage divider formed on the biasing input of the biasing network 32, using resistors 70 and 72. FIG. 4B illustrates the use of a Zener diode 74 to set the bias of the transistor 22.

Figure 5A:
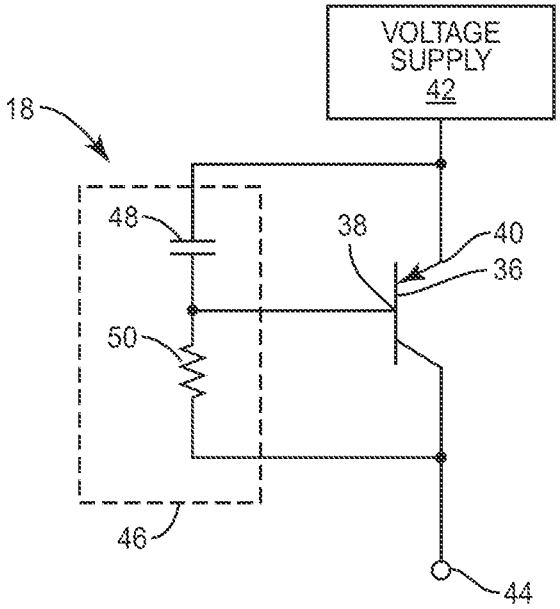
FIGS. 5A-5B depict circuit configurations of a single-transistor current source component of the floating current source according to embodiments.
Figure 5B:
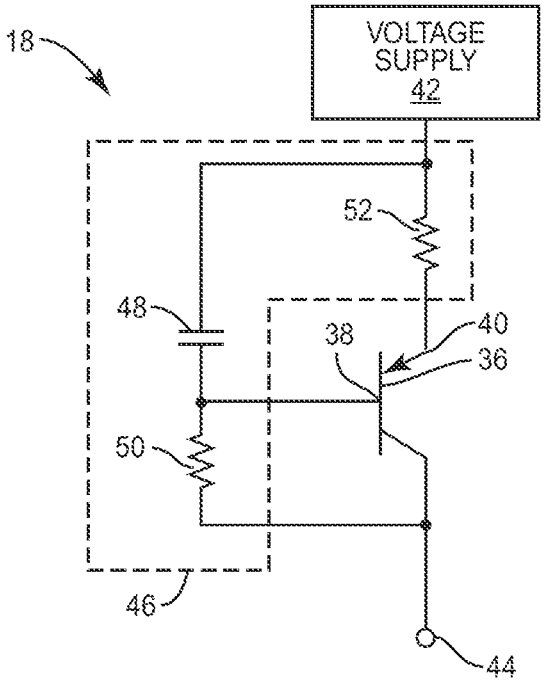

FIGS. 5A and 5B illustrate a PNP BJT based implementation of the single-transistor current source 18, where these implementations naturally complement the BJT-based implementations of the single-transistor current sink 20. One sees that the example biasing network 46 is set forth in much the same configuration as was detailed in FIG. 2. FIG. 5B, however, depicts the use of (resistive) element 52 as an emitter degeneration resistor for improved stability and linearity of the transistor 36 at its desired operating point.

Figure 6:
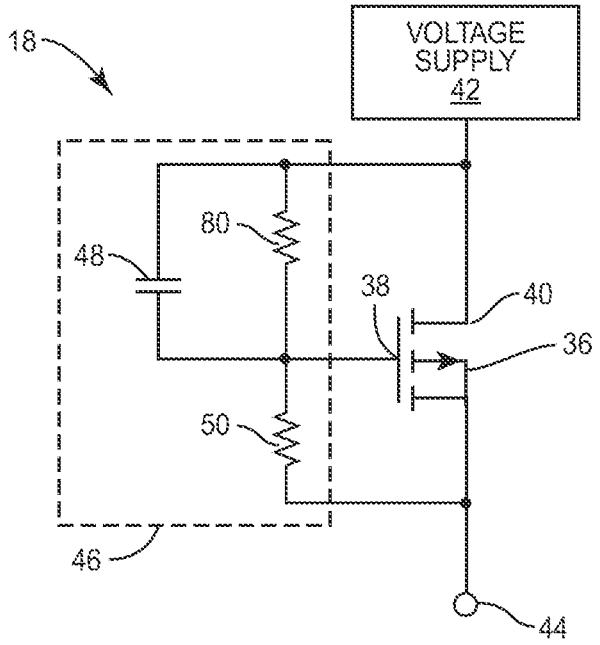
FIG. 6 depicts an additional circuit configuration of a single-transistor current source component of the floating current source according to an embodiment.

FIG. 6 illustrates a p-type MOSFET-based implementation of the transistor 36. Here, the biasing network 46 includes a voltage divider arrangement comprising a resistor 80 between the supply voltage input (the source terminal of the transistor 36) and the gate of the transistor 36, and the resistor 50 between the gate and the drain terminal of the transistor 36.

Figure 7:
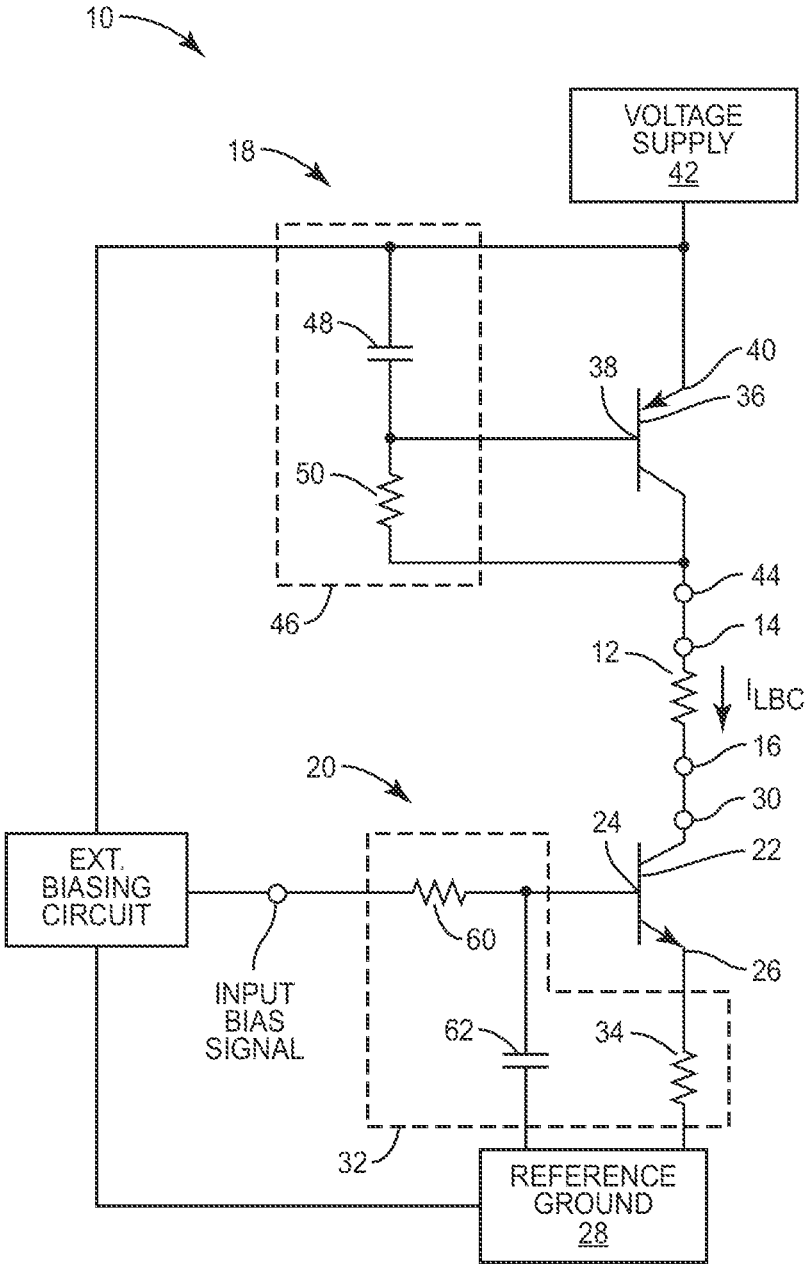
FIG. 7 depicts a floating current source coupled to a resistive load and configured to source a load biasing current across the resistive load according to an embodiment.

FIG. 7 presents an overall example embodiment of the contemplated floating current source 10, based on BJT-based transistors 22 and 36 and correspondingly configured biasing networks 32 and 46. The arrangement in FIG. 7, or variations of it, may be used in various applications.

Figure 8:
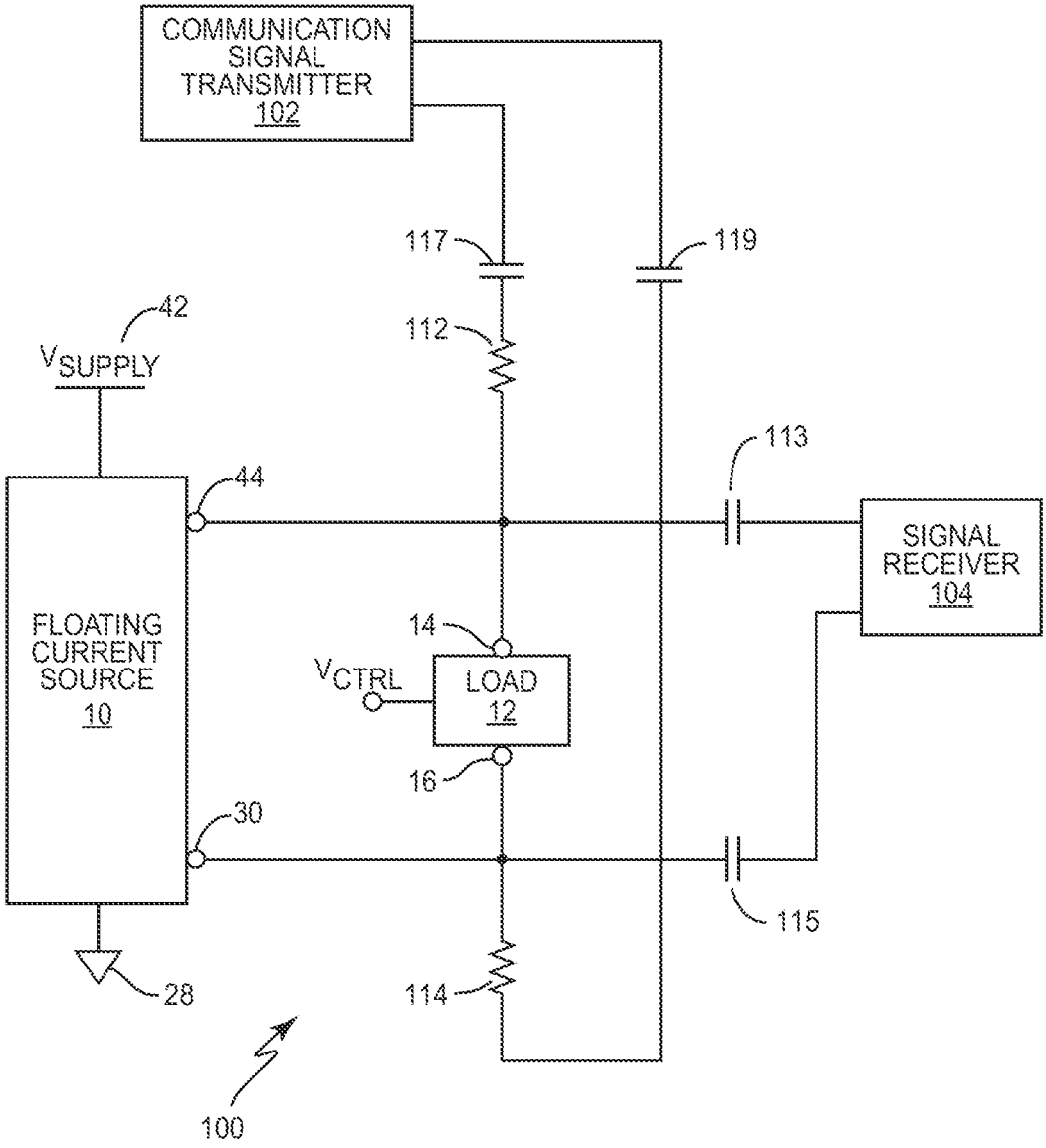
FIG. 8 depicts a block diagram of a floating current source as part of a communication signal test circuit.
Figure 9:
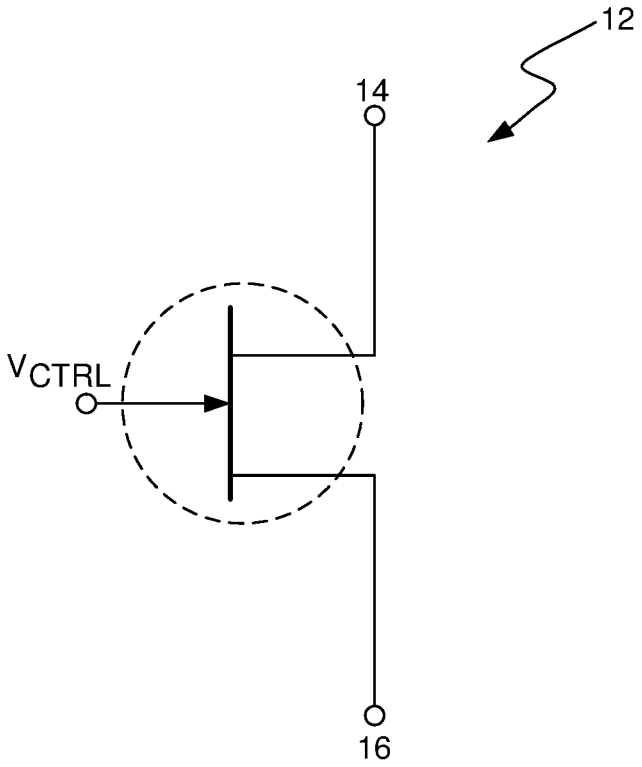
FIG. 9 is a diagram of a Junction Field-Effect Transistor (JFET) configured as a variable resistance load, for use with the floating current source contemplated herein.

FIG. 8 depicts an example application, wherein the contemplated floating current source 10 is used to implement a variable differential attenuator 100. The input to the differential attenuator is a communication signal transmitter 102 with one transmitter port attached to a capacitor 117, which in turn couples to the load terminal 14 through a resistor 112. The other transmitter port attaches to a capacitor 119, which in turn couples to the load terminal 16 through a resistor 114. Further, one input of a signal receiver 104 is attached to the load terminal 14 through a capacitor 113, while the other input of the signal receiver 104 is attached to the load terminal 16 through a capacitor 115.

In this example, the load 12 is a variable resistor that is used in concert with resistors 112 and 114 to create a differential variable attenuator. The floating current source 10 is used to properly bias the variable resistor with a fixed DC current. In some cases, this fixed DC current may be used to directly control the variable resistance. However, there will normally be a control voltage, VCTRL, that will be applied to load 12 to vary the resistance. Since this control voltage will normally be relative to a fixed DC voltage, it is important that the variable resistor 12 float at a known DC voltage relative to the control voltage reference. The floating current source 10 provides both the ability to supply a fixed known bias current and simultaneously float the load 12 at a known DC voltage. Further, as noted, the floating current source 10 is not perturbed by AC fluctuations on the source terminal 44, or on the sink terminal 30.

With the above example in mind, in at least one embodiment, the load 12 comprises a variable resistor whose resistance is proportional to the current through the variable resistor, which current is ideally provided by the floating current source 10. In the same or another embodiment, the load 12 comprises a variable resistor that must be biased at a specific current to operate properly and where the variable resistor must float at a known voltage with respect to a control voltage. In one example, the variable resistor is operative as a variable differential attenuator. Further, in at least one example, the variable resistor is a JFET.

As employed in this specification, the term "coupled" does not require that the elements must be directly coupled together. Intervening elements may be provided between the "coupled" elements.

As employed in this specification and the drawings, reference numerals are used for convenience in referring to the connectivity of various circuit elements. The reference numerals do not impose particular parameter values, such as a resistance or capacitance of the circuit elements described herein. Furthermore, identically numbered circuit elements in two or more of the embodiments described do not necessarily have the same parameter values. For instance, the resistor 60 depicted in FIG. 3A is not necessarily that same resistance as the resistor 60 in FIG. 3C. Parameter values of the individual circuit elements may be adapted according to design considerations, such as the circuit element type, e.g. MOSFET, BJTs, capacitors, etc. and parameter values, e.g. resistance and capacitance values, particular to a floating current source implementation as well as external requirements particular to a floating current source implementation.

Notably, modifications and other embodiments of the disclosed invention(s) will come to mind to one skilled in the art having the benefit of the teachings presented in the foregoing descriptions and the associated drawings. Therefore, it is to be understood that the invention(s) is/are not to be limited to the specific embodiments disclosed and that modifications and other embodiments are intended to be included within the scope of this disclosure. Although specific terms may be employed herein, they are used in a generic and descriptive sense only, and not for purposes of limitation.

What is claimed is:

1. A floating current source configured to source a load biasing current through a load having first and second terminals coupled to source and sink terminals of the floating current source, respectively, said floating current source comprising:

a first transistor having a first terminal operative as a first transistor biasing input, a second terminal coupled to a reference ground, and a third terminal coupled to the second terminal of the load and operative as the sink terminal;

a first biasing network coupled to the first transistor biasing input and configured to generate a first transistor biasing signal that sets a magnitude of the load biasing current, the first biasing network comprising a series resistor connected as a series resistance into the first terminal of the first transistor and configured to receive an input biasing signal;

a second transistor having a first terminal operative as a second transistor biasing input, a second terminal coupled to a voltage supply for drawing the load biasing current, and a third terminal coupled to the first terminal of the load and operative as the source terminal; and a second biasing network coupling the second transistor biasing input to the source terminal so as to automatically adjust a float voltage so that the magnitude of the load biasing current sourced from the voltage supply matches the magnitude set by the first biasing network;

wherein the second biasing network comprises a resistor connecting the third terminal of the second transistor to the first terminal of the second transistor, and an AC shunt coupling the first terminal of the second transistor to the voltage supply and thereby preventing AC fluctuations at the first terminal of the load from affecting the load biasing current.

2. The floating current source of claim 1, wherein the load biasing current controls the voltage across the first and third terminals of the second transistor and thereby determines the float voltage.

3. The floating current source of claim 1, wherein the second transistor is a PNP bipolar junction transistor, wherein the first terminal is the base terminal, the second terminal is the emitter terminal, the third terminal is the collector terminal.

4. The floating current source of claim 1, wherein the first transistor is an NPN bipolar junction transistor, wherein the first terminal is the base terminal, the second terminal is the emitter terminal, and the third terminal is the collector terminal.

5. The floating current source of claim 4, wherein the first biasing network further includes an emitter degeneration resistor in series between the emitter terminal of the first transistor and the reference ground.

6. The floating current source of claim 1, wherein the first biasing network further comprises a zener diode in shunt configuration from the first terminal of the first transistor to the reference ground.

7. The floating current source of claim 1, wherein the second transistor is a p-channel Metal-Oxide Semiconductor Field-Effect Transistor (MOSFET), wherein the first terminal is the gate terminal, the second terminal is the source terminal, the third terminal is the drain terminal, wherein the resistor connecting the drain terminal to the gate terminal comprises a first resistor in a resistive voltage divider, and wherein the resistive voltage divider includes a second resistor connecting the gate terminal to the voltage supply.

8. The floating current source of claim 1, wherein the first transistor is an n-channel Metal-Oxide Semiconductor Field-Effect Transistor (MOSFET), wherein the first terminal is the gate terminal, the second terminal is the source terminal, and the third terminal is the drain terminal, wherein the series resistor connected as said series resistance into the gate terminal comprises a first resistor of a resistive voltage divider, wherein the resistive voltage divider includes a second resistor connecting the gate terminal to the reference ground, and wherein the magnitude of the load biasing current depends on the resistive voltage divider.

9. The floating currents source of claim 1, wherein the first transistor is an n-channel Metal-Oxide Semiconductor Field-Effect Transistor (MOSFET), wherein the first terminal is the gate terminal, the second terminal is the source terminal, and the third terminal is the drain terminal, wherein the first biasing network further includes a zener diode between the gate terminal and the source terminal.

10. The apparatus of claim 1, wherein the load comprises a variable resistor whose resistance is proportional to the current through said variable resistor.

11. The apparatus of claim 1, where the load comprises a variable resistor that must be biased at a specific current to operate properly and where said variable resistor must float at a known voltage with respect to a control voltage.

12. The apparatus of claim 11, where said variable resistor is operative as a variable differential attenuator.

13. The apparatus of claim 12, where said variable resistor is a Junction Field-Effect Transistor (JFET).

* * * * *